United States Patent [19]

Subrick

[11] Patent Number: 4,783,001

[45] Date of Patent: Nov. 8, 1988

[54] UNIVERSAL NON-SPREADING RAILROAD TRACK HAULAGE TIE ASSEMBLY

[76] Inventor: Joseph Subrick, 2017 Revere Rd., Connellsville, Pa. 15425

[21] Appl. No.: 93,710

[22] Filed: Sep. 8, 1987

[51] Int. Cl.[4] ..... E01B 1/00; E01B 11/12; E01B 11/36; E01B 21/04

[52] U.S. Cl. ..... 238/53; 238/8; 238/51; 238/187; 238/213

[58] Field of Search ..... 238/8, 34, 50, 51, 53, 238/157, 195, 213, 217, 307, 6

[56] References Cited

U.S. PATENT DOCUMENTS

| | | | |
|---|---|---|---|
| 75,977 | 3/1868 | Reeves | 238/217 |
| 837,769 | 12/1906 | Allen | 238/53 |
| 948,496 | 2/1910 | Bricker | 238/53 |
| 1,016,621 | 2/1912 | Gillmor | 238/351 |
| 1,182,620 | 5/1916 | Bailey | 238/53 |
| 1,279,062 | 9/1918 | Winter | 238/8 |
| 1,498,326 | 6/1924 | Mueller | 238/53 |
| 2,658,688 | 11/1953 | Trylinski, Sr. et al. | 238/51 |
| 4,312,477 | 1/1982 | Hixson | 238/351 |

*Primary Examiner*—Carlton R. Croyle
*Assistant Examiner*—Leonard P. Walnoha
*Attorney, Agent, or Firm*—J. Gibson Semmes

[57] ABSTRACT

A universal non-spreading railroad track haulage tie and support therefor characterized by opposed rail supporting channels, coaxially aligned with the rails of a railroad, the channels being secured together and against the rails respectively by a tie gauge rod; including a modification for securing the tie rod and assembly to angle joint bars or splice bar assemblies which are conventionally used in the fitting of standard A.S.C.E. type rails and the like. The invention has particular utility in electric underground railway tracking. It may be affectively adapted to enchanced highway crossings of a railway, to repairs to existing conventional wood tie constructions to curves and switches of the steel railway, etc.

4 Claims, 2 Drawing Sheets

UNIVERSAL NON-SPREADING RAILROAD TRACK HAULAGE TIE ASSEMBLY

BACKGROUND OF THE INVENTION AND DESCRIPTION OF PRIOR ART

A.S.C.E. and like railroad bed rails are secured, conventionally, upon track beds by means of wooden ties, held to the rails by means of spikes driven through plates, into the wooden ties which are essentially ballasted. More recently, steel gauged rods have been developed for use with single shoulder and double shoulder tie plates. For example, gauge rods of Midwest Corporation have been designed for installation at weak points in track, sharp curves, switches and places of poor ballast, open pits, etc. The effect thereof is to prevent the spreading of rails, eliminate re-spiking of track and also to prevent undesireable tilting of rails. Nonetheless, such combinations, which include metal ties and anchors, some secured on rods and others upon corrugated ties, comprise very little support under each rail and in electric haulage, bonds are also required with such combinations. In the present invention, little or no ballast is required and on curves a thicker support channel can be used to elevate the steel ties for joint cross-bonds by welding the base of the rail to the channel; moreover steel tie construction switches, in accordance with the invention, may be prefabricated and transferred to a site of use.

The general effect in utility of the present invention resides in a reduction of the number of ties which must be required over a given length of railroad track, the strength of the track is increased inasmuch as the ties, per se do not rot, nor is there a requirement upon holding power of any spikes. The diameter of the rod can vary with strength requirements. A one inch rod provides approximately 75,000 pounds of track spreading resistance. In addition, excessive ballast is not needed to support a given rail on the tie, even though the only support may be immediately beneath the rail. Moreover, in conventional electric haulage, copper bonds are required to be welded at each track joint and cross copper bonds must be installed at frequent intervals between parallel rails. In the prior art, since bonds must be maintained in electric haulage they require continuous maintenance.

Accordingly, the present invention not only has the advantage of precluding the necessity for copper bonds in electric haulage, but a minimum of ballast needs application under a channel to support a given rail. As a consequence, approximately five or more inches of additional overhead mine clearance is available, as over the conventional wood tie constructions. Track installation time and expense is optimized hereby; the reinforcement of all track installations and especially areas of track near turn-out switches is effectively accomplished. Steel tie clips on both sides of a rail joint herein tend to reinforce the joint, by transferring the load to the solid rail opposite the joint.

The relevant prior art comprises Midwest Corporation/Midwest Steel gauge rods, rail anchors and tie plates. In addition, steel plank Trigon Ties have been known to include a form of corrugated steel tie to which may be secured tabs for engagement with the base of the railroad track. Such steel ties are lacking in direct support being available for the rail passing over the tie, per se. Whereas there are many other steel tie designs and manufacturers, such steel ties also tend to bend when "hump" exists between the rails and, when the bend occurs, the gauge is reduced, substantially. A minimum of material can be picked away to eliminate hump or the fulcrum effect by means of adapting the proposed invention.

In certain instances, conventional and special joint bars having common centerline bolt holes with a Crane Rail may be used in conjunction with the invention without modification thereto. The joint bars of Midwest Corporation are but one example, said joint bars engaging the rail beneath its head and base of a given rail on its top, without overlapping the transverse base extensions of the rail.

At present, it is proposed to include a redesigned splice bar to permit the tie clamping lug to be installed. Also, a special lug or clip may be installed and used to clamp the existing angle bars. This lug would be basically "higher" and the threaded portion of rod is accordingly increased.

To minimize wrecks occuring on curves, the up grade rail is 1 elevated, thus creating a "banked" curve. To obtain a uniform elevation, ballast must be increased under each tie and tamped to the exact level. This is expensive and time consuming and requires skilled "trackmen".

On the proposed tie, the channel height may be increased on the "up" grade side to give the exact elevation desired around the entire curve. This is a calculation determined by the radius of the curve, no skill required. Once this height is calculated, the configuration of the channel 130 may be varied to fit the need. The greater the height, the volume of ballast needed is increased. The larger volume channel may be desired on outside track. With respect to the variation in channel height on each side of the track, it is a feature of this invention to effect a "blocking" under and within the respective channels by means of wooden blocks, appropriately grooved for the rod, the block having excess height relative to the interior elevation of the channel to raise it and the track accordingly. See FIG. 4.

Railroad track being normally supported on wood ties, the track gauge is maintained by spikes driven into the wood tie on both sides of the rail. The ties are normally supported on limestone ballast to the depth of the wood tie and under its entire length. On curves the upper rail is normally elevated by adding additional ballast to provide a banked curve. The spikes only provide minimal strength to prevent the rails from spreading, as the wood tie decays the holding power decreases still further.

Track elevation for curves herein is effected by "blocking" as above-defined.

Only the ballast under the wood tie immediately below the rail supports the rail, therefore most of the ballast is wasted. If the ballast is tamped in the center of the tie it creates a fulcrum and causes the tie to break as the load passes over. On most steel ties the lugs are riveted to the base and are of questionable strength since they fail frequently.

Railroad wrecks occur because of:

(A) Track spreading due to the low holding effect of spikes driven into wood that eventually decays. When the track ballast is not maintained and/or poor drainage of the track exists, the load passing over this area creates up and down movement that pulls or loosens spikes and allows the track to spread. Steel tie rivets are of insufficient strength, and frequently fail and result in wide guage.

(B) A lip joint of loose track joints result when a joint moves because of inadequate ballast under ties or track bolts are not terminated properly or when bolts stretch.

(C) Low track joints normally result because inadequate or failure to maintain proper ballast under the ties.

(D) Wood ties decaying that result in poor support and failure of the holding power of the spikes.

(E) Improper elevation of the up grade side rail on turns.

(F) Excessive speed at switches and/or curves. Also on poorly maintained track.

(G) Haulage equipment failure or improper maintenance.

The proposed steel tie herein may be used to reinforce track in all vulnerable areas such as at joints, on curves, at track turnouts, etc. Track spreading can virtually be eliminated by utilizing the proper diameter rod for a given track system Curves can be elevated to exact height by utilizing elevated channel or installing "blocking" under the channel on the up grade side of a curve. See "blocking" aforesaid. Joints can be reinforced by the cross rod being secured to the solid rail, opposite the joint. A special system can be used to reinforce the joint if required. A channel longer than the angle bars can be used to secure two cross rods at each joint which is attached to the opposite solid rail with standard supports. A modified clip that secures to the angle bar herein can be used at track joints, this special joint bar permits the use of a standard clip opposite the joint.

DESCRIPTION OF THE PREFERRED EMBODIMENTS

Figure 1:
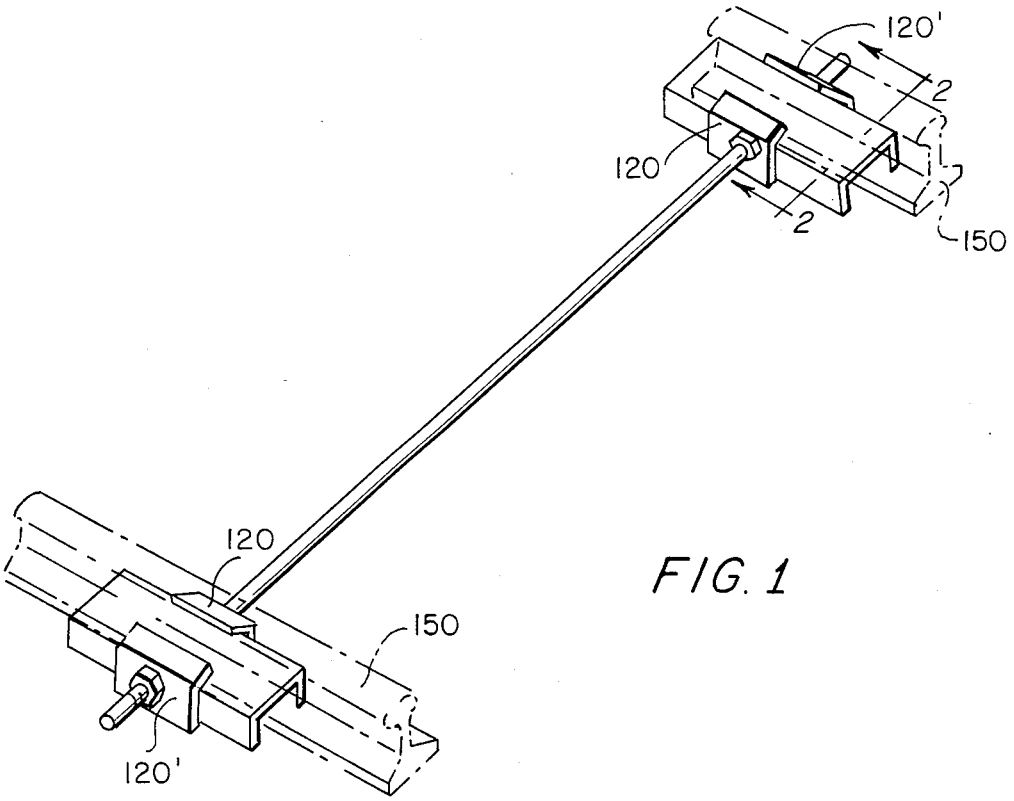
FIG. 1 is a view in perspective of an assembled track haulage tie in accordance with the invention, the same being applied to a conventional rail, intermediate ends thereof.
Figure 2:
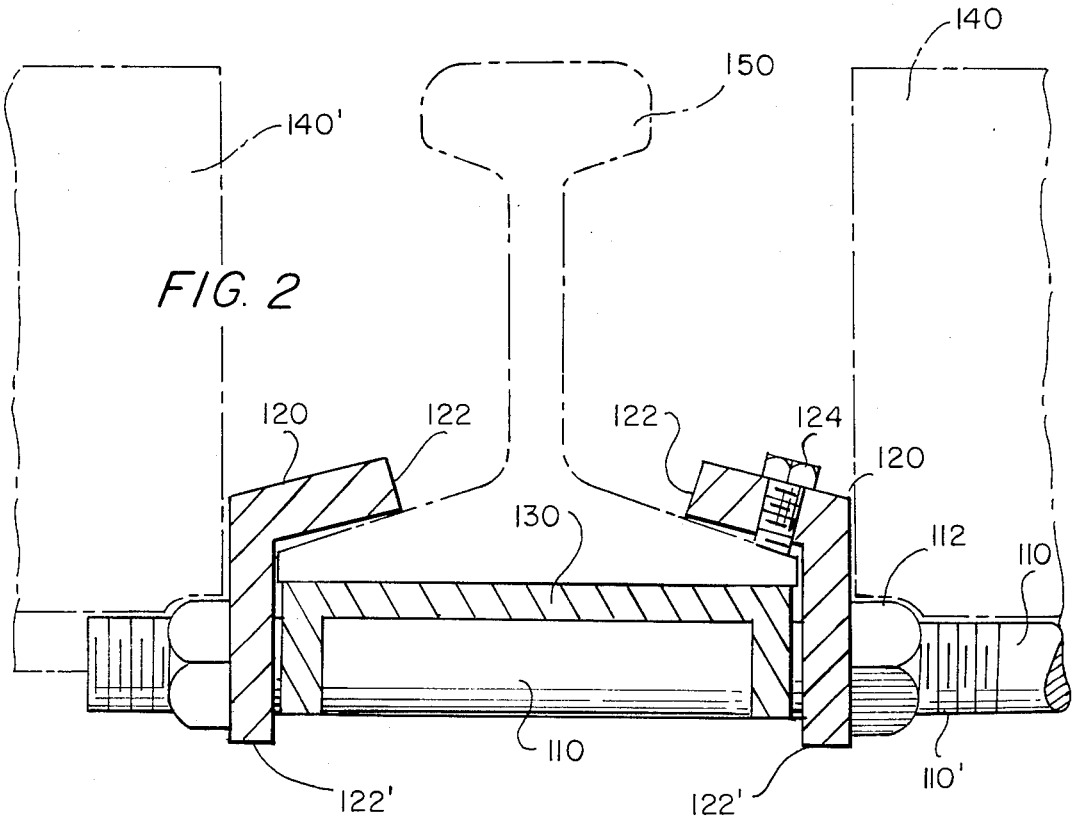
FIG. 2 is a view in vertical section of one half of the tie according to FIG. 1, taken along the lines 2—2 thereof.

The tie rod assembly of FIGS. 1 and 2, comprises a tie guage rod 110 extending transversely along the track bed, to secure into respective inner and outer lugs or clips 120-120', said lugs being spaced apart by the channel 130. The lugs may be of variant length, depending upon the amount of desired comprehensive contact on the rail and/or channel. This channel member is an elongated, inverted U-shaped support for the rail of the track. It rests upon the track bed ballast which works its way up into the channel and may overlie it as well as the gauge rod and clips. Thus cross-sectional shape can vary, depending on need. The lugs 120' may be set or welded into position to guarantee a preset gauge. With especial reference to FIG. 2 it will be noted that the rail 150 is adapted to rest upon the channel 130 at its base, the upper surfaces of the rail base forming compressive seats for the respective lug/clips, in the manner shown. The lug/clips, to insure compressive contact are essentially shaped to the angle of the base of the rail, the obtuse angle between the respective topmost and lowermost flanges being 1 to 2 degrees less than the acute angle of the top of the base of the rail which is generally at 103 to 104 degrees, relative to the horizontal, thus requiring the obtuse bend angle of the clips to be approximately at 101–102 degrees to provide a clamping force. Threads on the rod 110 at the innermost portions thereof should be terminated precisely to insure the required track guage upon securing the same to the lugs and respective channels by means of fasteners 112. See FIG. 2 wherein the threads 110' are shown. This shows threads extending past the nut. The respective channels 130 may extend variant lengths, end to end, depending upon the flotation effect desired, nonetheless, the width of the respective channels must be measured at less than the width of the base of a conventional rail, resting thereupon, to assure a compressive clamping force on the rail as the tie is secured thereto. Both height and increased volume of elements may be increased to permit more supporting ballast if needed.

As indicated in FIG. 2, a set screw 124 is desirably installed on the inside lugs to decrease resistivity when electric haulage is required. For this same purpose, the base of the solid rail may be tack welded to the channel 13 to decrease resistivity at a joint as between rails, hereinafter described.

Figure 3:
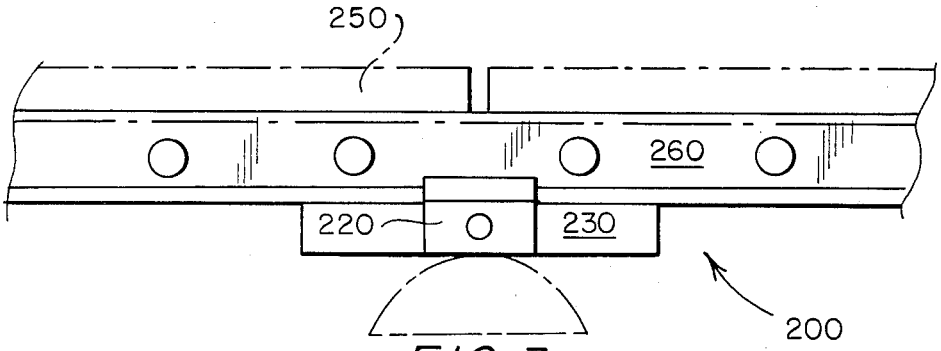
FIG. 3 is a view in side elevation of a modification of the invention as applied to abutting rails, the same being secured together by angle and/or splice bars.
Figure 4:
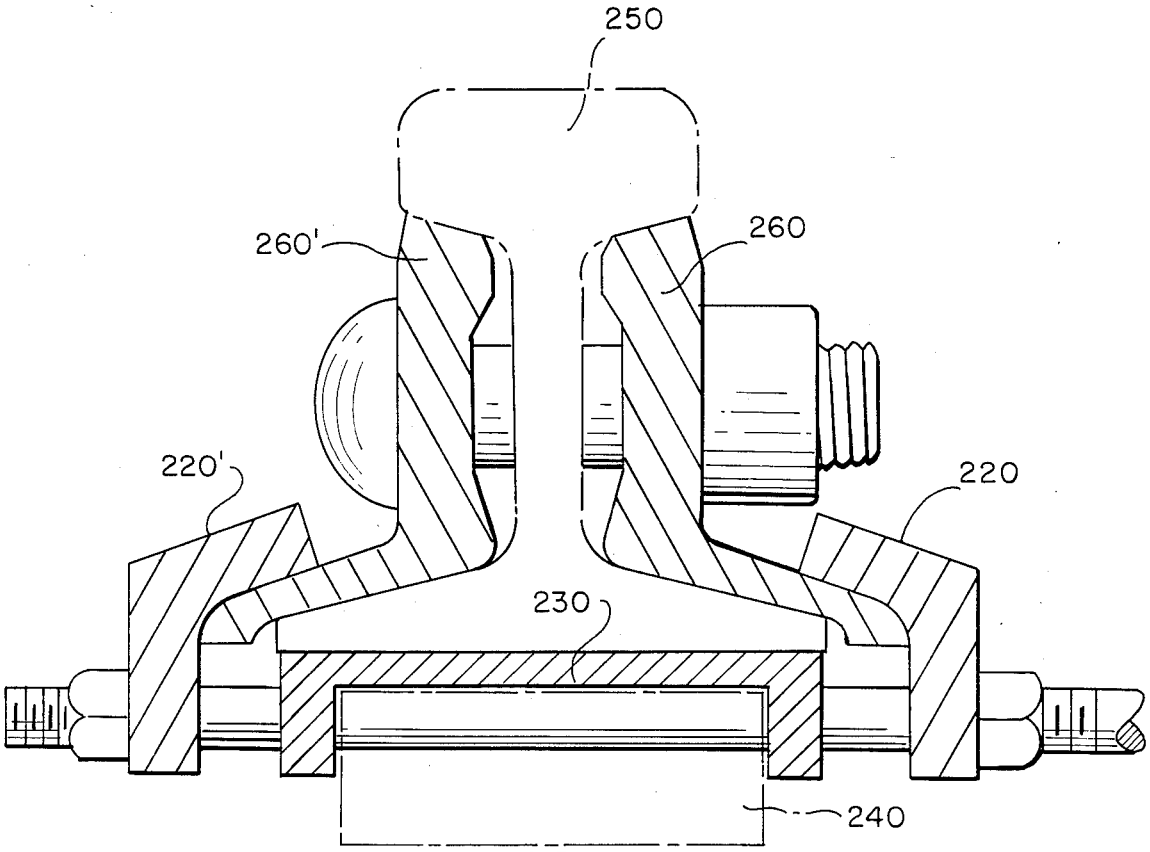
FIG. 4 is a vertical section view of one portion of the invention of FIG. 3, taken along the lines 4—4 thereof.

With reference to FIGS. 3 and 4, there is illustrated a modification of assembly 200, the assembly being adapted to the combination which may exist in the splicing of rails through the use of angle joint bars or angle and splice bars. In this modification, the tie at the rail joint requires that the lugs 220 must match the contour of the angle bar; also the spacing of the inner lugs must insure proper gauge to the track. Here, the combination includes rail base spaced lugs 220, 220', together with the channel 230 and appropriate rod 210. The solid rail is designated by the numeral 150 and the angle joints by the numerals 260–260', respectively representing inner and outer angle joints of the bar type. In this instance, the modified lugs 220–220' are adapted to clamp the angle bars whereby weak track joints may be reinforced by securing to the solid rail, opposite the joint. Obviously, similar rods may be passed through the angle bars securing them to the opposite solid rail with a standard lug, per bolt and special channel. As indicated above, desireable "blocking" is accomplished by introducing a fitted block of wood 240 or other substance such as an inverted, U-shaped fitted channel member up and into the overlying channel 230. When the assembly is rested upon the track bed ballast, the associated rail will be raised a predetermined height, thus yielding a desired banked elevation to a given rail, relative to the opposite rail as in construction of banked track curves and the like. See phantom line 240 of FIG. 4.

Another feature of the invention resides in the deposit for support of plural slabs of wood or reinforced concrete supported by the rods at a railway automotive roadway crossing. In this instance, the slabs when finally fit and secured by the rods have an elevation which is substantially the same as the ball of the parallel rail, adjacent thereto. See phantom lined elements 140 - 140' of FIG. 2.

I claim:

1. A railroad track haulage tie assembly for parallel rails wherein each rail has connected running and base elements, comprising:

(a) a tie rod which exceeds track co-extension laterally from rail to rail;

(b) opposed, elongated rail supporting channels, adjustably disposed relative to each said rail, each channel engaging opposite ends of the rod at the right angle thereto for seating and supporting respective rails at preselected opposed points longitudinally beneath the base of each rail, the width of each said channel being less than the width of the base of the given rail, (c) pairs of inside and outside clips wherein respective clips are L-shaped in vertical cross-section, the angle defined by a compressive leg thereof being less than the angle defined by the sloped top of the base of the disengaged rail, said clips compressively engaging the channels and the rails sidewise, whereby to compressively mount said opposed rails in pre-set track relationship.

2. The railroad track haulage tie assembly of claim 1 wherein at least one channel supporting block is disposed within and beneath the channel to effect an increased elevation to tie and associated track at the location of interconnection thereto.

3. The railroad track haulage tie assembly of claim 1 wherein angle joint bars are adapted to join abutting rails, the respective clips defining extended flanges which overlap the angle joint bars to compress them against the rail bases thereof and the supporting channel, whereby to reinforce the joint by transferring a given load thereon in the opposite transverse direction.

4. The railroad track haulage tie assembly of either claim 3, in combination with one or more automotive roadway upright slabs, said slabs each being disposed upon the tie rods at right angles thereto, said slabs having a maximum laid height limit which is substantially the same as the elevation limit of the ball of a parallel rail, adjacent thereto.

* * * * *